US005988254A

United States Patent [19]

Hanright

[11] Patent Number: 5,988,254

[45] Date of Patent: Nov. 23, 1999

[54] WASHABLE WINDOW SHADE WITH REMOVABLE COMPONENTS

[76] Inventor: Connie A. Hanright, P.O. Box 1045, Rome, N.Y. 13442-1045

[21] Appl. No.: 09/106,380

[22] Filed: Jun. 29, 1998

[51] Int. Cl.[6] ..... A47H 5/032

[52] U.S. Cl. ..... 160/84.01; 160/264

[58] Field of Search ..... 160/84.01, 84.04, 160/84.05, 264, 124, 243

[56] References Cited

U.S. PATENT DOCUMENTS

| | | | |
|---|---|---|---|
| 3,777,800 | 12/1973 | Susoev | 160/84.04 |
| 4,739,815 | 4/1988 | Altman | 160/84.01 |
| 4,934,435 | 6/1990 | Regev | 160/84.04 |
| 4,986,329 | 1/1991 | Kupchunos | 160/84.01 |
| 5,273,096 | 12/1993 | Thomsen et al. | 160/84.01 |
| 5,355,928 | 10/1994 | Robertson | 160/84.04 |
| 5,690,156 | 11/1997 | Ruggles | 160/84.04 |
| 5,738,159 | 4/1998 | O'Brien | 160/84.01 |

*Primary Examiner*—David M. Purol

*Attorney, Agent, or Firm*—Weiner & Burt, P.C.; Pamela S. Burt; Irving M. Weiner

[57] ABSTRACT

A washable window shade in which all non-washable components are readily removable. The washable window shade includes a main shade member made of a decorative, washable fabric such as silk, cotton, or a natural or synthetic blend. Stiffener members provided on the main shade member to maintain it flat are either removable or provided in a washable form. A drawstring assembly for raising and lowering the main shade member is also removable, as is a rigid bottom member. All removable parts can be conveniently removed before washing and conveniently re-assembled after washing, all without the use of tools.

17 Claims, 3 Drawing Sheets

FIG 1
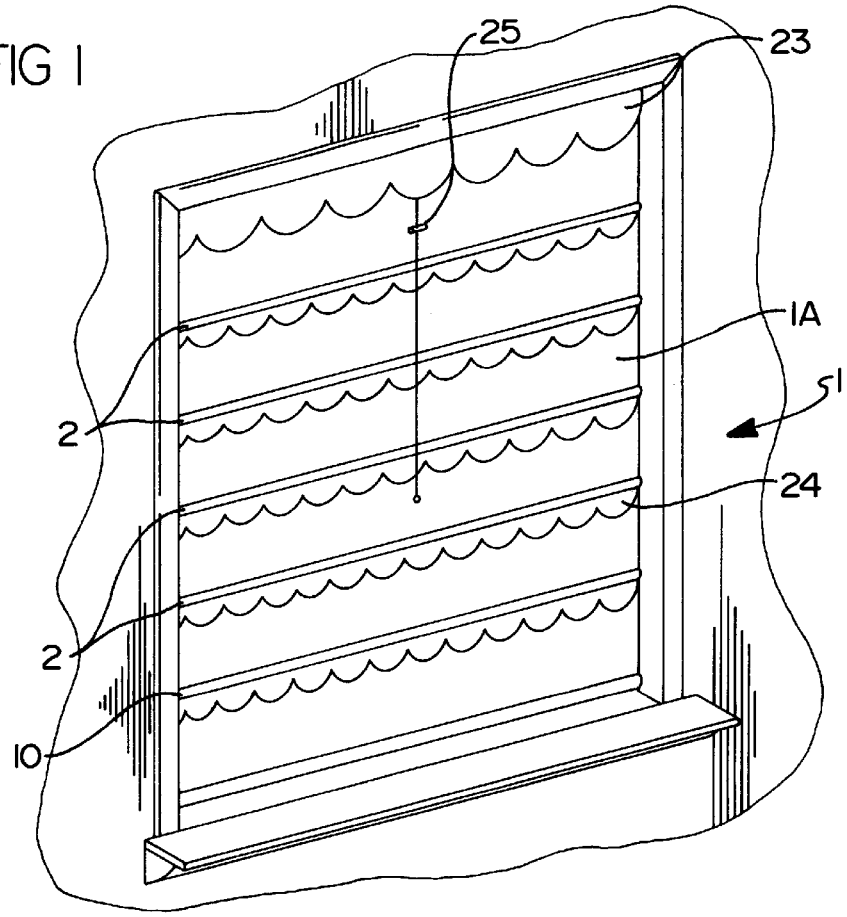
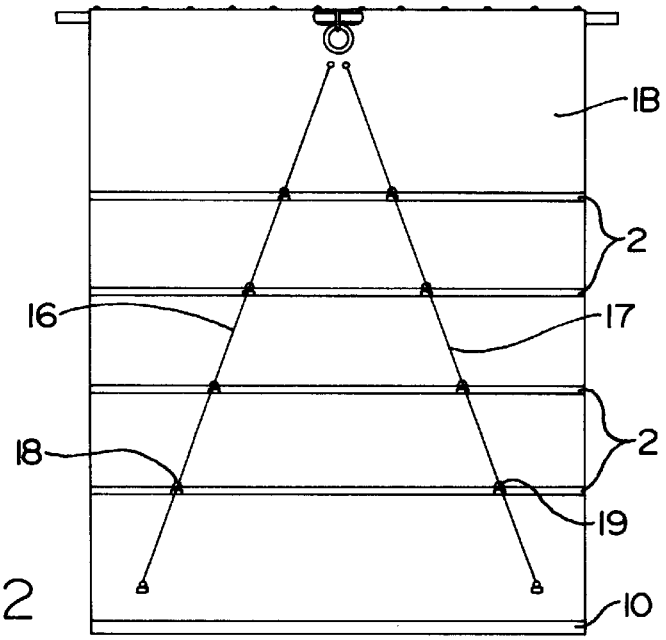
FIG 2

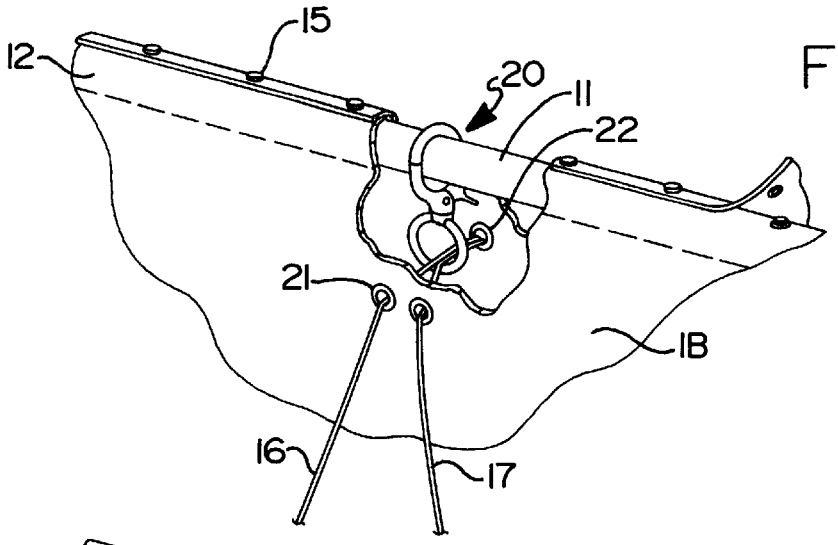
FIG 3
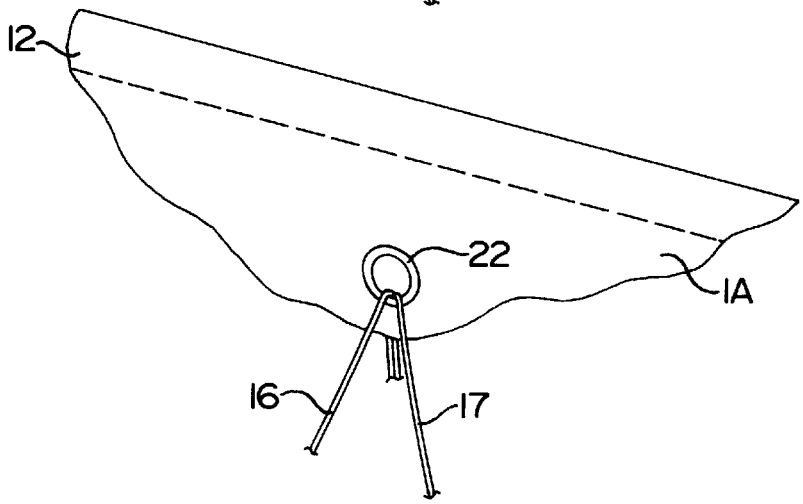
FIG 4
FIG 5
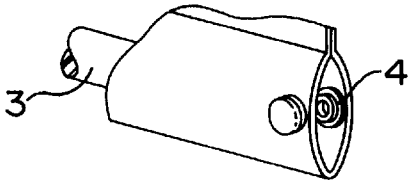
FIG 7
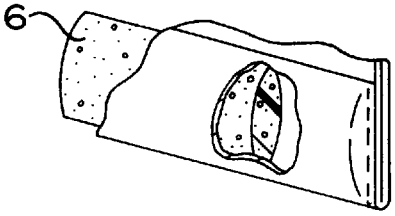
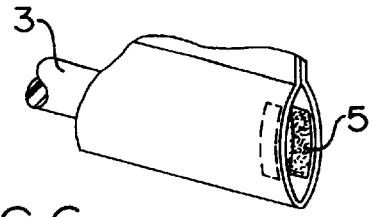
FIG 6
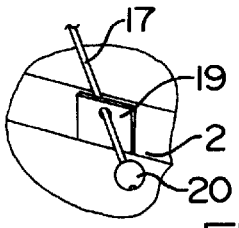
FIG 8

WASHABLE WINDOW SHADE WITH REMOVABLE COMPONENTS

BACKGROUND OF THE INVENTION 1. Field of the Invention

The present invention relates generally to a window shade which may be easily assembled and disassembled so that non-washable components can be readily removed to permit washing, by hand or machine, of the main window shade member. More particularly, the invention relates to a multi-component window shade having a number of components which may be readily removed and re-assembled without the use of tools, and a main shade member which is washable by hand or machine once the other components are removed.

It will be understood that the terminology "washable" as employed herein is intended to connote any form of washing or cleaning of the window shade, including by hand, by machine, and/or by dry cleaning or the like.

2. Description of Relevant Art

Conventional window shades have an integral tension mechanism including an upper support rod around which the main shade member is wound and unwound to permit raising and lowering of the shade. Typically, the main shade member is fabricated of vinyl or the like, and is integrally attached to the upper support rod provided with the tension mechanism. Over time, the conventional window shade becomes soiled, dusty, and/or discolored, eventually becoming so unsightly as to require replacement. While some limited cleaning of the shade may be possible by hand wiping of the main shade member, effective and thorough cleaning of the shade is impossible due to the integral construction of non-washable components.

Other known window treatments, such as blinds, are likewise subject to becoming dirty and/or discolored over time, without being capable of thorough washing. Conventional curtains or drapes, on the other hand, may be removed from their hanging supports (such as curtain rods and/or drapery hooks), so that they are capable of thorough washing or dry cleaning. However, conventional curtains and drapes are incapable of being vertically raised and lowered in the manner of window shades, while also lacking the more tailored appearance of window shades.

The present invention effectively overcomes the foregoing disadvantages associated with conventional window coverings by providing a window shade having the functional attributes of a conventional window shade while permitting thorough washing, by hand or machine, of the main shade member.

SUMMARY OF THE INVENTION

The present invention provides a washable window shade having a substantially rectangular main shade member fabricated of flexible, washable material. Upper retaining means are provided for removably receiving and retaining therein a support rod, the upper retaining means being provided along an upper edge portion of the main shade member. The support rod is adapted to support the window shade from external support surfaces adjacent a window pane to be covered. Also provided are lower retaining means for removably receiving and retaining therein a substantially rigid elongated bottom member, the lower retaining means being provided along a lower edge portion of the main shade member. The washable window shade further includes stiffening means for maintaining the main shade member in a substantially flat configuration in an open position, the stiffening means comprising a plurality of spaced apart, substantially rigid elongated members. A plurality of intermediate retaining means are provided for removably receiving and retaining therein the plurality of stiffening members respectively, the plurality of intermediate retaining means extending substantially horizontally across spaced-apart intermediate portions of the main shade member. Operating means are provided for raising and lowering the main shade member, the operating means extending from a lower portion to an upper portion of the main shade member. The support member, the bottom member, and the operating means are all removable from the main shade member prior to washing, without the use of tools. In a first embodiment, the stiffening members are also removable before washing, while in a second embodiment the stiffening members remain in the main shade member while it is washed.

It is an object of the invention to provide an aesthetically appealing and practical window shade which permits convenient removal of non-washable components prior to washing or dry cleaning, without the use of tools.

A further object of the invention is to provide a washable window shade which can be conveniently re-assembled after the main shade member is washed, without requiring any tools.

Yet another object of the invention is to provide a window shade having adjustable stiffener members in the form of telescoping poles, to accommodate window shades of varying widths.

The above and further objects, details, and advantages of the present invention will become apparent from the following detailed description, when read in conjunction with the accompanying drawings.

BRIEF DESCRIPTION OF THE DRAWINGS

FIG. 1 is a front perspective view of a washable window shade according to the invention, as mounted to cover a window.

FIG. 2 is a rear elevational view of the window shade of FIG. 1.

FIG. 3 shows an upper back portion of the window shade of FIG. 1, partially cut-away to show a drawstring support member of the invention.

FIG. 4 is a rear view of the front side portion of the shade, showing drawstrings extending therethrough.

FIG. 5 is a cut-away view of one end of a stiffener of the washable window shade according to the invention.

FIG. 6 is a cut-away view of one end of a stiffener of the washable window shade according to the invention, having an alternative closure member.

FIG. 7 is a cut-away view showing one end of another embodiment of a stiffener of the window shade.

FIG. 8 is a cut-away view of one end of a drawstring of the window shade.

DETAILED DESCRIPTION OF PREFERRED EMBODIMENTS

Figure 9:
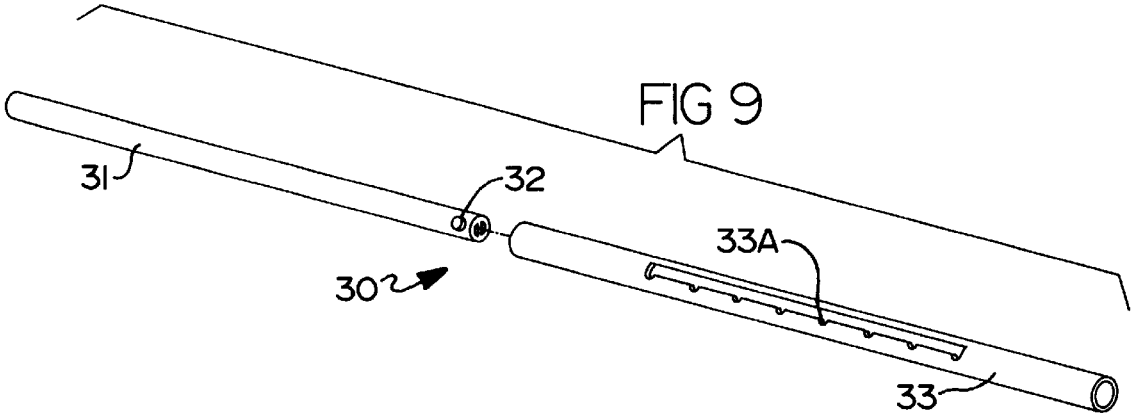
FIG. 9 is a perspective view of a telescoping pole employed in a second embodiment of the washable window shade of the invention, as disassembled.

With reference to FIGS. 1–8, a first preferred embodiment of the washable window shade according to the invention will be described. The washable window shade is shown in FIG. 1 as mounted to cover a window. Although the window shade is shown in FIG. 1 as an inside-mount arrangement, wherein the shade is disposed within the frame members of the window, it will be understood that the invention is not limited to an inside-mount arrangement. An outside-mount arrangement can alternatively be employed, in which the window shade is mounted to an outside window frame or wall portion so as to extend beyond the window frame.

The washable window shade according to the invention comprises a substantially rectangular main shade member 1 having a front side 1A which faces into the room, and a back side 1B facing the window. The shade 1 is fabricated of two co-extensive layers of flexible material which are stitched or otherwise joined together along side edge portions thereof, top and bottom portions thereof, and intermediate horizontal pocket portions thereof, as described in greater detail below, so that the front side 1A is defined by a first sheet of material and the back side 1B is defined by a second sheet of material. The material used in fabricating the shade 1 may comprise any suitable fabric having desired decorative and light-blocking qualities, such as silk, cotton, or any other natural or synthetic material or blend of materials. To enhance the light blocking effect of the shade, heavier or relatively opaque fabric may be employed.

It will be understood that while the two sheets of fabric defining front side 1A and back side 1B of the shade may be the same material with the same color(s) or pattern(s), the two sheets may alternatively comprise different fabrics so that the front and back sides of the shade will have different appearances. By way of example, it may be desirable to use a decorative colored or patterned fabric for the front side of the shade which faces the room, while using a white fabric or one which blends well with the exterior of a building, for example, for the back side of the shade. Regardless of the particular fabric(s) used to construct shade 1, an important quality of the fabric is that it be washable, either by hand and/or machine, or suitable for being dry cleaned.

As shown in FIGS. 1, 2, and 5–7, the shade 1 comprises stiffening means in the form of a plurality of substantially horizontal stiffeners 2 extending entirely across the width of shade 1. The stiffeners 2 function to support retainers for a drawstring as will be described below, while also functioning to hold the relatively flexible material of shade 1 substantially flat without bending or curling along the edges. While four stiffeners 2 are shown in FIGS. 1 and 2, it will be understood that any desired number of stiffeners may be provided, depending upon such variables as the length and width of the window and the type of fabric employed for shade 1.

The stiffeners 2 comprise intermediate retaining means in the form of horizontal, elongated pockets formed in shade 1. Each pocket may be defined by a pair of parallel stitch lines extending across the width of the shade so as to join the two layers of shade 1 together along the stitch lines and thereby define a pocket therebetween. Stiffeners 2 further comprise a stiffening clement which may take the form of a relatively rigid rod 3 (FIGS. 5 and 6) made of plastic or the like inserted into each of the thus-formed pockets. As shown in FIGS. 5 and 6, where the stiffening element is provided in the form of rod 3, one end of each elongated pocket defined in shade 1 is provided with closure means permitting selective opening and closing of the pocket end so as to remove rod 3 therefrom. In FIG. 5, the closure means comprises a snap closure 4, while in FIG. 6 an alternative closure means is shown in the form of a Velcro® type closure 5. Any suitable closure means may be employed, provided that it permits convenient opening and closing of the end of the pocket for removal and insertion of rod 3. Preferably, the open pocket ends of the respective stiffeners 2 are provided along the same side of shade 1, while the opposite ends of the pockets along the opposite side of shade 1 may preferably be stitched or otherwise permanently closed. In this respect it will be understood that the side edges of the front and back sides 1A, 1B of shade 1 are joined together by stitching or the like substantially entirely along their lengths, with the exception of the ends of the pockets of stiffeners 2, as described.

Instead of rods 3, the stiffening elements of stiffeners 2 may alternatively comprise stiffening material 6 (FIG. 7) stuffed relatively tightly into the elongated pockets. The stiffening material may comprise any suitable material which is relatively stiff or form retentive when stuffed into the stiffener pockets, and washable. By way of example, the stiffening material may comprise closely packed fabric, facing material such as used by seamstresses, foam material, etc. When the stiffening elements comprise such stiffening material, both ends of each elongated pocket of stiffeners 2 are preferably permanently closed by stitching or the like as shown in FIG. 7, because the washable stiffening material is adapted to remain within the pockets during washing.

In addition to the stiffeners 2, the shade 1 is provided with a substantially rigid bottom member 10. Similar to the stiffeners 2, bottom member 10 comprises lower retaining means which may take the form of an elongated horizontal pocket extending entirely across the width of the bottom edge of the shade 1. A substantially rigid rod-shaped or flat rigid member made of plastic or the like is inserted into the bottom pocket through an open pocket end which is selectively closed by suitable closure means such as a snap or Velcro(t closure as shown in FIGS. 5 and 6. Preferably, the open pocket end of the bottom member 10 is provided along the same side of shade 1 as the open pocket ends of stiffeners 2 where such open ends are provided, while the opposite end of the pocket of bottom member 5 may preferably be stitched or otherwise permanently closed.

The top of shade 1 is supported by any suitable support rod 11 (FIG. 3) for mounting the window shade to a window frame or surrounding wall portion. For example, support rod 11 may comprise a cafe-type curtain rod or other type of curtain rod. For an inside-mount shade arrangement as shown in FIG. 1, a tension-type telescoping cafe rod may desirably be employed. To this end, provided along the top edge of shade 1 is upper retaining means which may take the form of an elongated horizontal pocket 12 (FIG. 3) extending across the entire width of shade 1. To facilitate insertion of the curtain rod into top pocket 12, a plurality of snap closure elements 15 (FIG. 3) or the like may preferably be provided at regular intervals along top open edges of pocket 12. The snap closures 15 also permit access to a central drawstring support member 20 described in detail below, which can be accessed simply by unsnapping several of the central snap closures.

The drawstring arrangement which permits opening and closing of shade 1 will now be described with reference to FIGS. 1–4. As shown in FIG. 2, a pair of drawstrings 16, 17 extend along the back side 1B of shade 1. Each drawstring 16, 17 extends through a plurality of drawstring retainers in the form of tabs 18, 19 respectively. The tabs 18, 19 are secured by stitching or the like to the back side of the pocket of bottom member 10 and the pockets of stiffeners 2, and are positioned so as to gradually approach the center of shade 1 from the bottom to the top, as shown in FIG. 2. Tabs 18, 19 may be fabricated of any suitable material which is strong enough to withstand the stresses applied by the drawstrings, and which is washable. Each tab 18, 19 is provided with a small eyelet or reinforced aperture (FIG. 8) through which the respective drawstrings 16, 17 extend. It is contemplated that the apertured tabs 18, 19 may alternatively comprise small plastic rings sewn in the appropriate positions, or any other suitable means for guiding the drawstrings and which is washable.

As shown in FIG. 8, the lower end of drawstring 17 inserted in the lowermost tab 19 extends through a bead 20 and is knotted so that the bead 20 will serve as a stop member for the drawstring. A similar arrangement (not shown) is provided at the lower end of drawstring 16. After then passing through the plurality of converging tabs 18, 19, respectively, the drawstrings 16, 17 are received through a pair of eyelets 21, 21, respectively, provided in the back side 1 B of shade 1, and then through a lower ring of drawstring support member 20, as shown in FIG. 3. The drawstring support member 20 may comprise a swivel-type trigger snap having an upper ring which may be selectively snapped into position around the curtain rod 11. It will be understood, however, that drawstring support member 20 may take any suitable form, provided that it can be selectively attached to curtain rod 11 and is capable of supporting drawstrings 16, 17.

After passing through the ring of drawstring support member 20, drawstrings 16, 17 are passed through an eyelet 22 provided in the front side 1A of shade 1. As shown in FIG. 4, which is a view from the rear of front side 1A of shade 1, the drawstrings 16, 17 extend through eyelet 22 from the rear to the front of front side 1A of shade 1. The drawstrings 16, 17 are then passed through the through hole of a drawstring stopper member 25 (FIG. 1). The drawstring stopper member 25 may be of the type commonly provided on the drawstrings of garments, having a button which is depressed to permit the drawstrings to slide therethrough and then released to lock the stopper member in position. It is contemplated, however, that any suitable means for locking the drawstrings in a desired position may be employed.

As shown in FIG. 1, the eyelet 22 may preferably be concealed from view by a top front flap 23 sewn or otherwise affixed along the top of shade 1. The flap 23 may be shaped, colored, and/or patterned for a desired decorative effect. Similar decorative flaps 24 may likewise be provided along each of the stiffeners 2 and the bottom of the shade as shown in FIG. 1. If desired, the flaps 23 and/or 24 may alternatively be formed of lace.

In use, the washable window shade assembled as described above is moved from the closed, window covering position shown in FIG. 1 to an open position by pulling on the drawstrings until the shade 1 is pulled up to the desired position. The stopper 25 is then moved upwardly until it abuts against the eyelet 22 and thus locks the drawstrings in their drawn position. Releasing the stopper 25 by means of its pushbutton permits the drawstrings to either slide back therethrough or be pulled forwardly therethrough, so that the shade may be conveniently raised and lowered as desired. As the shade 1 is raised, the fabric of the shade folds upon itself, while lowering of the shade permits the fabric to unfold while the stiffeners 2 maintain the desired flat, even appearance.

To disassemble the shade for washing, the drawstrings are pulled rearwardly through eyelet 22, the ring of drawstring support 20, the eyelets 21, and the series of tabs 18, 19. The stiffening elements 3 may then be conveniently removed from their respective pockets, or if stiffening material is alternatively provided (FIG. 7), it remains in place for washing. The rigid rod or other member is also removed from the bottom pocket of shade 1. Further, the drawstring support 20 and curtain rod are removed from the top pocket of shade 1 by unsnapping snap closures 15 as necessary. At this stage, all non-washable components have been conveniently and easily removed without the use of any tools, and the shade 1 is ready to be washed by hand or machine, or to be dry cleaned if desired. After washing, the user simply reverses the above sequence of steps to conveniently reassemble the window shade, again without requiring any tools.

Figure 10:
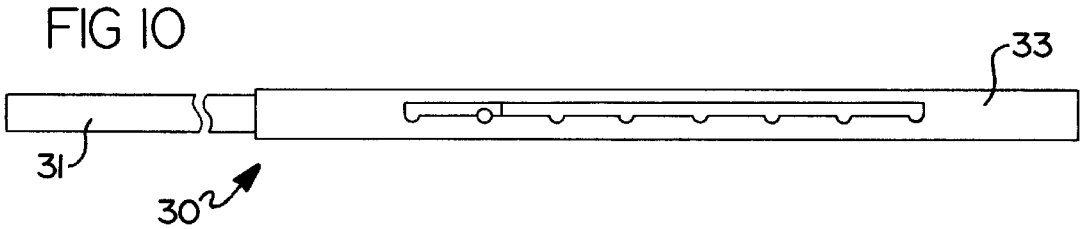
FIG. 10 is a view of the telescoping pole of FIG. 9, as assembled.
Figure 11:
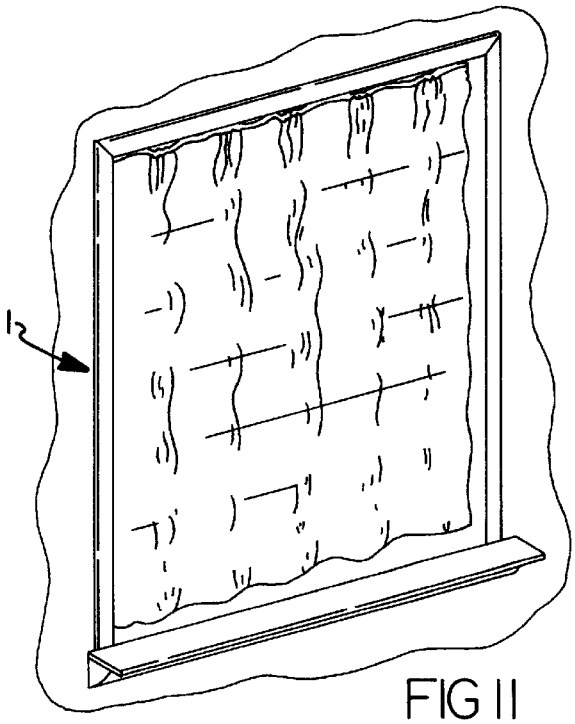
FIG. 11 is a front perspective view of a washable window shade according to the second embodiment of the invention, as mounted to cover a window.

An alternative embodiment of the invention which permits adjustment to accommodate windows of varying widths will now be described with reference to FIGS. 9–11. The washable window shade of the second embodiment is substantially the same as described above with respect to the first embodiment, except that adjustable poles are employed instead of the fixed size stiffeners and bottom member of the first embodiment.

In the second embodiment, the stiffeners 2 and bottom member 10 are similar to those described above with respect to the first embodiment inasmuch as a plurality of horizontal pockets are provided across the width of shade 1 and closure means for selectively closing one end of the pockets are provided as shown in FIGS. 5 and 6. In this embodiment, however, the rods 3 and the rod or other rigid element of bottom member 10 are replaced by expandable poles in the form of a telescoping pole 30 as shown in FIGS. 9 and 10. The poles 30 are preferably substantially cylindrical and hollow, and are fabricated of a lightweight rigid material such as plastic.

Each pole 30 comprises a first section 31 provided with a spring-biased pushbutton 32 which is normally biased outwardly but which may be pushed inwardly. The pole 30 further comprises a second section 33 having a slightly larger diameter than first section 31 so that first section 31 is closely received within second section 33 as shown in FIG. 10. The second section 33 is provided with an elongated slot having a series of spaced apart cut-away indents 33A provided along one edge thereof. The indents 33A are provided at regular intervals of one inch, one-half inch, or other desired increments. The slot provided with indents 33A is dimensioned to prevent pushbutton 32 from extending therethrough except at each of the indents 33A, which each define a sufficient opening for the pushbutton 32 to extend therethrough.

The pole 30 is adjusted in length simply by pushing in on pushbutton 32 and sliding pole section 31 inwardly within pole section 33 until the pushbutton 32 protrudes outwardly through the desired indent 33A. To facilitate proper adjustment, pole section 33 is preferably marked adjacent each of the indents 33A with a number (not shown) corresponding to the overall width dimension of pole 30 when the pushbutton 32 is engaged within any given one of the indents. For example, if the indents 33A are spaced at regular one-inch intervals, the indents would be marked 31, 32, 33, etc., corresponding to the final width in inches of the pole 30 as adjusted.

By virtue of the adjustability of poles 30, the washable window shade of the second embodiment of the invention can be readily adjusted, without the use of tools, to accommodate windows, and shades 1, of varying width dimensions. In addition, a fuller, gathered, or ruffled appearance is achieved by making the shade 1 oversized in width relative to the width dimension of the window, to achieve the gathered appearance shown in FIG. 11. To this end, elastic strips or beads (not shown) may preferably be stitched to the back side 1B of shade 1 substantially across the width thereof, such as along a seam of each of the respective pockets of stiffeners 2 and bottom member 10. Preferably, each elastic strip or bead extends across the width of shade 1 to within approximately one inch from each side edge. The elastic as thus provided will serve to gather the shade 1 in an aesthetically pleasing manner as shown from the front in FIG. 11.

While there have been described above what are at present considered to be the preferred embodiments of the invention, it will be understood that various modifications may be made therein without departing from the spirit and scope of the invention. The present embodiments are therefore to be considered in all respects as illustrative, and not restrictive. The scope of the invention is indicated by the appended claims rather than by the foregoing description.

I claim:

1. A washable window shade, comprising:

a substantially rectangular main shade member fabricated of flexible, washable material;

said main shade member comprising a front side which faces into a room when said window shade is in an installed position and a back side which faces a window when said window shade is in said installed position;

upper retaining means for removably receiving and retaining therein a support rod, said upper retaining means being provided along an upper edge portion of said main shade member;

said support rod being adapted to support said window shade from external support surfaces adjacent a window pane to be covered;

lower retaining means for removably receiving and retaining therein a substantially rigid elongated bottom member, said lower retaining means being provided along a lower edge portion of said main shade member;

stiffening means for maintaining said main shade member in a substantially flat configuration in an open position, said stiffening means comprising a plurality of spaced apart, substantially rigid elongated members;

a plurality of intermediate retaining means for removably receiving and retaining therein said plurality of stiffening members respectively, said plurality of intermediate retaining means extending substantially horizontally across spaced-apart intermediate portions of said main shade member;

operating means for raising and lowering said main shade member, said operating means extending from a lower portion to an upper portion of said main shade member;

said support member, said bottom member, said stiffening means, and said operating means being removable from said main shade member without the use of tools;

said operating means for raising and lowering said main shade member comprising:

a pair of drawstrings;

two sets of drawstring retainers arranged in spaced apart relation on said back side of said main shade member, each said set comprising a plurality of retainers arranged in substantially vertically spaced apart relation on said back side of said main shade member such that said two sets converge substantially towards each other in an upward direction;

said drawstrings having lower ends thereof removably affixed to lower portions of said back side of said main shade member, and extending upwardly therefrom through said sets of retainers, respectively;

an upper drawstring support member supported on said support rod and comprising a support portion for receiving said drawstrings therethrough;

upper ends of said drawstrings extending through an aperture provided in said back side of said main shade member, through said support portion of said drawstring support member, and forwardly through an aperture provided in said front side of said main shade member; and a drawstring stopper member received over said upper ends of said drawstrings on said front side of said main shade member, said stopper member comprising means for selectively holding said drawstrings in a desired drawn position.

2. A washable window shade according to claim 1, wherein:

said main shade member comprises first and second substantially co-extensive layers of fabric;

said first layer of fabric defines said front side of said main shade member; and said second layer of fabric defines said back side of said main shade member.

3. A washable window shade according to claim 1, wherein:

said upper retaining means comprises an upper elongated pocket formed along said upper edge portion of said main shade member;

said lower retaining means comprises a lower elongated pocket formed along said lower edge portion of said main shade member;

said plurality of intermediate retaining means comprise a plurality of elongated intermediate pockets extending substantially horizontally across spaced-apart intermediate portions of said main shade member; and said lower pocket and said plurality of intermediate pockets are each provided with an open end portion provided with means for selectively closing said end portion, said open end portions of said pockets all being disposed at a common side edge of said main shade member.

4. A washable window shade according to claim 1, wherein:

a decorative flap is disposed along an upper edge portion of said front side of said main shade member, said decorative flap being disposed in front of said drawstring aperture so as to cover same.

5. A washable window shade according to claim 4, wherein:

said drawstring retainers of each of said sets are respectively affixed to back side portions of said intermediate pockets and said lower pocket; and said drawstring retainers are fabricated of a washable material.

6. A washable window shade according to claim 3, wherein:

each of said upper, lower, and intermediate pockets are defined between respective portions of said front and back sides of said main shade member;

said upper pocket has an open upper end defined by opposing upper edge portions of said front and back sides of said main shade member; and a plurality of closure members are provided along said upper edge portions to permit selective opening and closing of said upper pocket.

7. A washable window shade according to claim 3, wherein:

each of said upper, lower, and intermediate pockets extend substantially entirely across the width of said main shade member; and each of said upper, lower, and intermediate pockets are defined by parallel lines of stitching through said front and back sides of said main shade member, such that said pockets are defined between respective portions of said front and back sides of said main shade member.

8. A washable window shade according to claim 2, wherein:

said first and second layers of fabric each comprise a natural silk fabric.

9. A washable window shade according to claim 2, wherein:

said first and second layers of fabric each comprise a synthetic blend of fabric material.

10. A washable window shade, comprising:

a substantially rectangular main shade member fabricated of flexible, washable material;

said main shade member comprising a front side which faces into a room when said window shade is in an installed position and a back side which faces a window when said window shade is in said installed position;

upper retaining means for removably receiving and retaining therein a support rod, said upper retaining means being provided along an upper edge portion of said main shade member;

said support rod being adapted to support said window shade from external support surfaces adjacent a window pane to be covered;

lower retaining means for removably receiving and retaining therein a substantially rigid elongated bottom member, said lower retaining means being provided along a lower edge portion of said main shade member;

stiffening means for maintaining said main shade member in a substantially flat configuration in an open position, said stiffening means comprising:

a plurality of intermediate retaining means for removably receiving and retaining stiffening material therein;

said plurality of intermediate retaining means extending substantially horizontally across spaced-apart intermediate portions of said main shade member; and said stiffening material being closely packed within said intermediate retaining means;

operating means for raising and lowering said main shade member, said operating means extending from a lower portion to an upper portion of said main shade member;

said support member, said bottom member, and said operating means being removable from said main shade member without the use of tools;

said operating means for raising and lowering said main shade member comprising:

a pair of drawstrings;

two sets of drawstring retainers arranged in spaced apart relation on said back side of said main shade member, each said set comprising a plurality of retainers arranged in substantially vertically spaced apart relation on said back side of said main shade member such that said two sets converge substantially towards each other in an upward direction;

said drawstrings having lower ends thereof removably affixed to lower portions of said back side of said main shade member, and extending upwardly therefrom through said sets of retainers, respectively;

an upper drawstring support member supported on said support rod and comprising a support portion for receiving said drawstrings therethrough;

upper ends of said drawstrings extending through an aperture provided in said back side of said main shade member, through said support portion of said drawstring support member, and forwardly through an aperture provided in said front side of said main shade member; and a drawstring stopper member received over said upper ends of said drawstrings on said front side of said main shade member, said stopper member comprising means for selectively holding said drawstrings in a desired drawn position.

11. A washable window shade according to claim 10 wherein:

said main shade member comprises first and second substantially co-extensive layers of fabric;

said first layer of fabric defines said front side of said main shade member; and said second layer of fabric defines said back side of said main shade member.

12. A washable window shade according to claim 10, wherein:

said upper retaining means comprises an upper elongated pocket formed along said upper edge portion of said main shade member;

said lower retaining means comprises a lower elongated pocket formed along said lower edge portion of said main shade member;

said plurality of intermediate retaining means comprise a plurality of elongated intermediate pockets extending substantially horizontally across spaced-apart intermediate portions of said main shade member; and said lower pocket is provided with an open end portion provided with means for selectively closing said end portion.

13. A washable window shade according to claim 10, wherein:

said drawstring retainers of each of said sets are respectively affixed to back side portions of said intermediate pockets and said lower pocket; and said drawstring retainers are fabricated of a washable material.

14. A washable window shade according to claim 12, wherein:

each of said upper, lower, and intermediate pockets are defined between respective portions of said front and back sides of said main shade member;

said upper pocket has an open upper end defined by opposing upper edge portions of said front and back sides of said main shade member; and a plurality of closure members are provided along said upper edge portions to permit selective opening and closing of said upper pocket.

15. A washable window shade according to claim 14, wherein:

each of said upper, lower, and intermediate pockets extend substantially entirely across the width of said main shade member; and each of said upper, lower, and intermediate pockets are defined by parallel lines of stitching through said front and back sides of said main shade member, such that said pockets are defined between respective portions of said front and back sides of said main shade member.

16. A washable window shade, comprising:

a substantially rectangular main shade member fabricated of flexible, washable material;

upper retaining means for removably receiving and retaining therein a support rod, said upper retaining means being provided along an upper edge portion of said main shade member;

said support rod being adapted to support said window shade from external support surfaces adjacent a window pane to be covered;

lower retaining means for removably receiving and retaining therein a substantially rigid elongated bottom member, said lower retaining means being provided along a lower edge portion of said main shade member;

stiffening means for maintaining said main shade member in a substantially flat configuration in an open position, said stiffening means comprising a plurality of spaced apart, substantially rigid elongated members;

a plurality of intermediate retaining means for removably receiving and retaining therein said plurality of stiffening members respectively, said plurality of intermediate retaining means extending substantially horizontally across spaced-apart intermediate portions of said main shade member;

operating means for raising and lowering said main shade member, said operating means extending from a lower portion to an upper portion of said main shade member;

said bottom member and said stiffening members each comprising a pole which is adjustable in width;

said support member, said bottom member, said stiffening members, and said operating means being removable from said main shade member without the use of tools;

said adjustable-width poles each comprising a telescoping pole which is adjustable to a plurality of predetermined lengths so as to accommodate windows of varying widths.

17. A washable window shade according to claim 16, wherein:

said main shade member comprises first and second substantially co-extensive layers of fabric;

said first layer of fabric defines a front side of said main shade member which faces into a room when said window shade is in an installed position;

said second layer of fabric defines a back side of said main shade member which faces a window when said window shade is in an installed position;

said upper retaining means comprises an upper elongated pocket formed along said upper edge portion of said main shade member;

said lower retaining means comprises a lower elongated pocket formed along said lower edge portion of said main shade member;

said plurality of intermediate retaining means comprise a plurality of elongated intermediate pockets extending substantially horizontally across spaced-apart intermediate portions of said main shade member; and said lower pocket and said plurality of intermediate pockets are each provided with an open end portion provided with means for selectively closing said end portion, said open end portions of said pockets all being disposed at a common side edge of said main shade member.

* * * * *